US008403054B2

(12) United States Patent
Udipi et al.

(10) Patent No.: US 8,403,054 B2
(45) Date of Patent: Mar. 26, 2013

(54) TORQUE TRIPPING MECHANISM FOR A VALVE

(75) Inventors: Mahesha Udipi, Houston, TX (US); David Daniel Comeaux, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 12/870,518

(22) Filed: Aug. 27, 2010

(65) Prior Publication Data

US 2012/0048565 A1 Mar. 1, 2012

(51) Int. Cl.
*E21B 34/04* (2006.01)

(52) U.S. Cl. ..... 166/338; 166/368; 166/373; 166/331; 192/56.6

(58) Field of Classification Search ..... 166/335, 166/338–341, 364, 368, 373, 381, 386, 316, 166/330, 331; 251/213; 137/315.35
See application file for complete search history.

(56) References Cited

U.S. PATENT DOCUMENTS

| | | | | | |
|---|---|---|---|---|---|
| 3,329,243 | A | * | 7/1967 | Gibb | 188/134 |
| 3,675,745 | A | * | 7/1972 | Bouhot | 188/134 |
| 3,967,647 | A | * | 7/1976 | Young | 137/614.11 |
| 4,009,753 | A | * | 3/1977 | McGill et al. | 166/55.1 |
| 4,234,043 | A | * | 11/1980 | Roberts | 166/336 |
| 4,325,409 | A | * | 4/1982 | Roberts | 137/596.14 |
| 4,325,434 | A | * | 4/1982 | Roberts | 166/321 |
| 4,460,078 | A | * | 7/1984 | Heide et al. | 192/56.5 |
| 4,545,470 | A | * | 10/1985 | Grimm | 464/36 |
| 4,898,265 | A | * | 2/1990 | Metcalf | 192/223.3 |
| 4,943,187 | A | * | 7/1990 | Hopper | 405/190 |
| 5,010,919 | A | * | 4/1991 | Partridge | 137/527.4 |
| 5,166,677 | A | * | 11/1992 | Schoenberg | 340/853.3 |
| 6,715,555 | B2 | * | 4/2004 | Milberger et al. | 166/368 |
| 7,308,902 | B2 | * | 12/2007 | Williams et al. | 137/15.18 |

FOREIGN PATENT DOCUMENTS

GB 1498699 A 1/1976

OTHER PUBLICATIONS

GB Search Report dated Nov. 21, 2011 from orresoonding Application No. GB1114442.5.

* cited by examiner

*Primary Examiner* — Matthew Buck
(74) *Attorney, Agent, or Firm* — Bracewell & Giuliani LLP

(57) ABSTRACT

A torque limiter for use in an actuating drive stem of a subsea wellhead having a collar with an axial bore and a slot through its side. The slot includes a projection directed towards a lower end of the collar and has an edge oriented oblique to the collar axis. A driven shaft inserts in the bore, and a pin mounted in the driven shaft engages the slot. A spring assembly coupled to the driven shaft pushes the collar to retain the pin in the end of the projection. A driveshaft with a drive pin inserts into the bore on an upper side of the collar. The upper end of the collar includes a shoulder that contacts the drive pin when the collar rotates. The spring compresses when excessive torque is in the driven shaft moving the pin up the projection and disengaging the drive pin and shoulder.

6 Claims, 3 Drawing Sheets

TORQUE TRIPPING MECHANISM FOR A VALVE

FIELD OF THE INVENTION

This invention relates in general to production of oil and gas wells, and in particular to a device for limiting torque delivered to a stem being actuated by a remotely operated vehicle subsea.

DESCRIPTION OF RELATED ART

Subsea wellbores are formed from the seafloor through subterranean formations lying underneath. Systems for producing oil and gas from subsea wellbores typically include a subsea wellhead assembly set over a wellbore opening. A typical subsea wellhead assembly includes a high pressure wellhead housing supported in a lower pressure wellhead housing and secured to conductor casing that extends downward past the wellbore opening. Wells are generally lined with one or more casing strings coaxially inserted through, and significantly deeper than, the conductor casing. The casing strings are suspended from casing hangers landed in the wellhead housing. One or more tubing strings are provided within the innermost casing string; that among other things are used for conveying well fluid produced from the underlying formations. A production tree mounts to the upper end of the wellhead housing for controlling the well fluid. The production tree is typically a large, heavy assembly, having a number of valves and controls mounted thereon.

Shafts are included with the wellhead assemblies for actuating or adjusting devices on or within the wellhead assemblies; where the devices include valves and clamps, among others. A remotely operated vehicle (ROV) is often used to rotate the shafts. Connection between an ROV and a shaft generally involves the ROV grappling a handle on an end of a shaft or a receptacle connected to the shaft. Although ROVs are calibrated to exert a designated rotational force to the shaft, a calibrating mistake or other malfunction can cause the ROV to provide a torque exceeding the yield strength of the shaft.

SUMMARY OF THE INVENTION

Disclosed herein is a valve for use in a subsea assembly. In an example embodiment the valve includes a member that is stroked open and closed by a shaft that can rotate. A torque limiting device prevents excess torque from damaging the shaft. The torque limiter locks the shaft and valve member together so when the shaft rotates the valve member is stroked to open or close. When a designated torque is exceeded in the shaft, the torque limiter releases the valve member and shaft to prevent damage in the shaft. The torque limiting device can be reset from the released position to the locked position. In one example embodiment, the torque limiting device includes an annular collar with a profile. When the torque limiter is in the locked position, the profile engages an end of the rotatable shaft. To release the shaft and valve member, the torque limiter axially moves the collar the profile disengages from the shaft. In an example, the rotatable shaft is a driveshaft, and the collar also rotatingly engages a driven shaft. A driven member mounts to the driven shaft and contacts a portion of an outer edge of a slot formed in a sidewall of the collar. Orienting the portion of the outer edge contacted by the driven member oblique to an axis of the collar causes the driven member to slide along the outer edge in a direction that approaches the end of the collar having the profile for disengaging the collar from the driveshaft. The profile can be a shoulder formed on an upper end of the collar that contacts a drive member provided on the driveshaft when the torque limiting device is in a locked position. In an alternative example, when the driven member slides along the edge of the slot towards the profile, the collar is moved axially so that the profile is urged axially away from the drive member. A portion of the slot can project in a direction away from the profile with lateral sides oriented oblique to an axis of the collar that intersect to define a wedge shaped drive end of the slot. When the drive member slides along the lateral sides away from the drive end of the slot, the torque limiting device can change from the locked position to the released position. Optionally includes is a spring member mounted on the driveshaft for urging the collar into a position for rotating engagement with both the driveshaft and the driven shaft.

Also disclosed herein is a torque limiter for limiting torque transmitted from a driven shaft to a driveshaft. In an example embodiment, the torque limiter includes a body that extends past ends of the driven shaft and the driveshaft, where the body can be selectively moveable from an engaged position to a disengaged position. Also included in this embodiment is a shoulder on the body that couples to and rotates with the driveshaft when the body is in the engaged position. A coupling is further included that engages the driven shaft and the body. The coupling slides the body from the engaged position to a disengaged position when the driven shaft rotates with a designated torque. In an example embodiment, the coupling is made up of a profiled slot in the body, a portion of the profiled slot is oblique to an axis of the driven shaft. A driven member projects from the driven shaft into the profiled slot. The body can be selectively moveable into the engaged position from the disengaged position by reversing the rotational direction of the driven shaft. A spring can optionally be included that is attached to the driven shaft and compressed against an end of the body to retain the body in the engaged position. Optionally, the shoulder is a surface set along a radius of an axis of the driveshaft and along the axis of the driveshaft that contacts a pin projecting radially outward from the driveshaft to rotate the driveshaft when the body is in the engaged position.

A method is disclosed herein for actuating a valve. In an example embodiment the method includes, providing a torque limiter, where the torque limiter includes a collar with a driven end and a drive end selectively engagable with a valve stem. The method further includes engaging the valve stem with the drive end and inserting an end of a driven shaft into the driven end. A collar is coupled with the driven shaft so that when the driven shaft is at a designated torque the collar slides with respect to the driven shaft in a direction from the driven end toward the drive end to disengage the drive shaft from the valve stem. The method can further include rotating the driven shaft so that the collar and valve stem are rotated to actuate a valve member attached to the valve stem. Engagement between the drive end and the collar can be maintained by continuing to apply an urging force on an end of the collar. The collar can be engaged with the driven shaft by forming a coupling made up of a driven member affixed to the driven shaft, a profile in the collar engaged by the driven member and having a portion set oblique to an axis of the driven shaft. Applying an axial force on the collar slides the driven member along the profile when the torque in the driven shaft is at the designated torque. The designated torque may be applied by rotating the driven shaft. The drive shaft can be reengaged with the valve stem by rotating the driven shaft in a direction opposite to the direction of rotation that disengaged the drive shaft and valve stem.

DETAILED DESCRIPTION OF THE INVENTION

Figure 1:
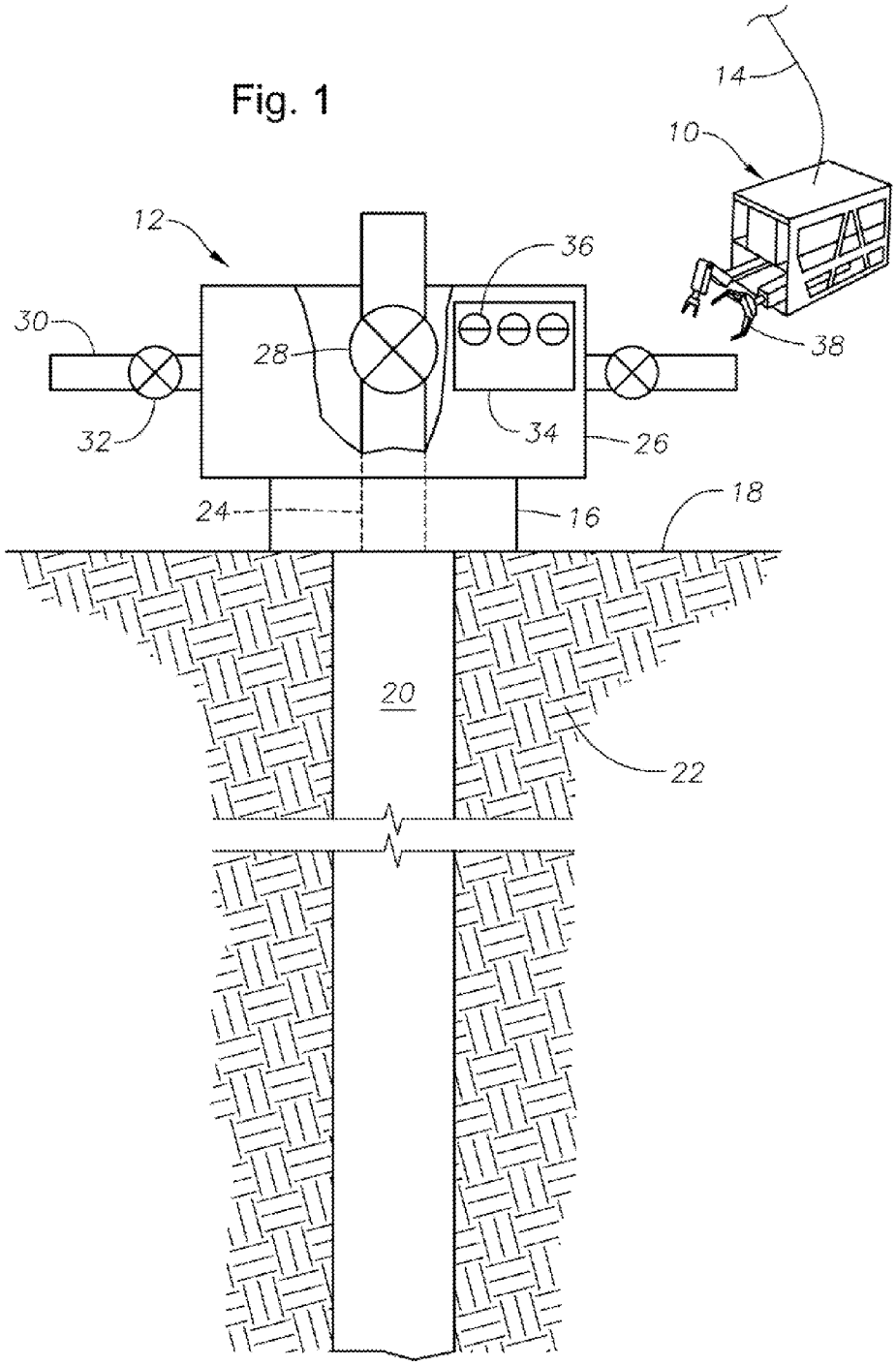
FIG. 1 is a side schematic view of a remotely operated vehicle (ROV) being lowered to a subsea assembly.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Shown in FIG. 1, in a side schematic view, is an example of a remotely operated vehicle (ROV) approaching a subsea assembly 12 and controlled via a control line 14. The subsea assembly 12 includes a wellhead housing 16 shown set on the sea floor 18. The wellhead housing 16 is further located above a borehole 20 formed into a formation 22 under the sea floor 18. A main bore 24 is shown in a phantom line within the subsea assembly 12 and in communication with the borehole 20. A production tree 26 is shown set on the wellhead housing 16 and having the main bore 24 therein. A swab valve 28 shown in phantom line in the portion of the main bore 24 inside the production tree 26. Flow lines 30 exiting the sides of the production tree 26 include wing valves 32 for controlling flow through the flow lines 30. An ROV panel 34 is provided on a side of the production tree 26 and includes panel receptacles 36. The panel receptacles 36 may couple to one or more of the valves 28, 32 or other actuatable items within the subsea assembly 12 and are engageable by ends of an ROV arm 38 provided with the ROV 10.

Figure 2A:
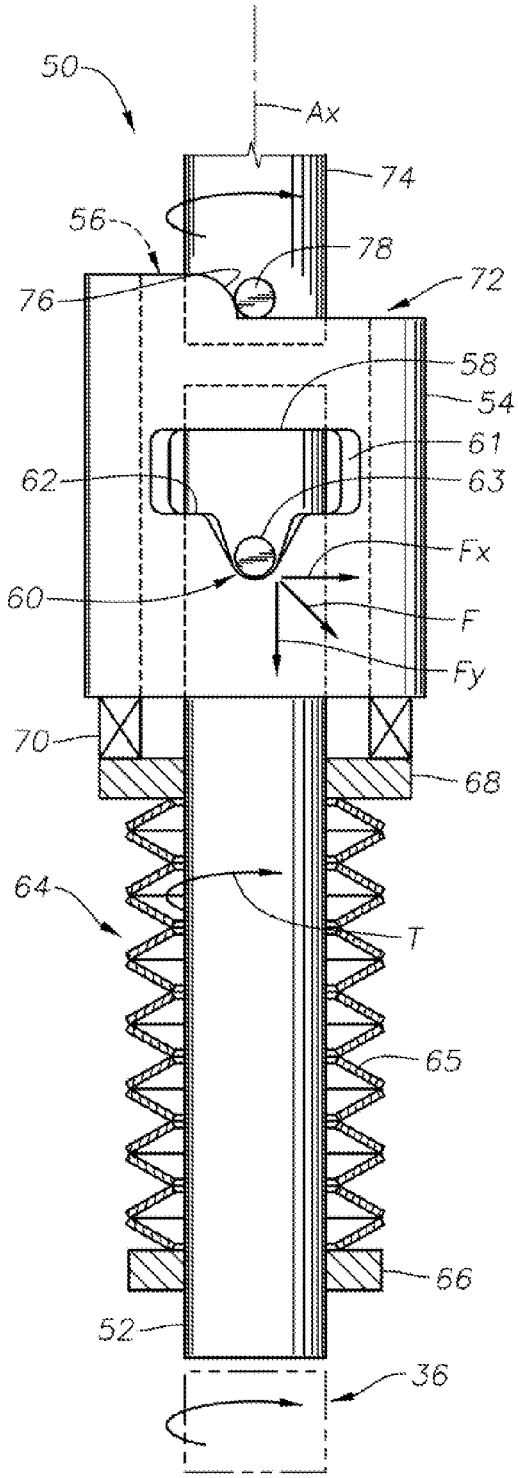
FIG. 2A is a side schematic view of an example embodiment of an engaged torque tripping mechanism in accordance with the present disclosure.

A side partial sectional view of an example embodiment of a torque limiter 50 is illustrated in FIG. 2A. A driven shaft 52 is illustrated having an end coupled to a panel receptacle 36. Thus, rotating the receptacle 36 with the arm 38 of the ROV 10 (FIG. 1) in turn rotates the driven shaft 52. A collar 54 is coaxially set over a portion of the driven shaft 52 and includes an axial bore 56 in which is inserted the end of the driven shaft 52 opposite the receptacle 36. A cammed slot 58, having a projection 60 and an upper portion 61, is formed through a side of the collar 54. The projection 60 of FIG. 2A extends to a side of the collar 54 in which the driven shaft 52 is inserted and has lateral sides converging towards one another. Where the lateral sides meet is a generally curved portion that defines a lower end of the slot 58. The lower end of the slot 58 is closer to the input end of the collar 54 than the generally rectangularly shaped upper portion 61. The upper portion 61 extends along the circumference of the collar 54 past the upper ends of the lateral sides of the projection 60. A ledge 62 is defined where the upper portion 61 projects along the circumference of the collar 54 lateral to the projection, where the ledge is substantially perpendicular to an axis $A_X$ of the torque limiter 50.

Still referring to FIG. 2A, a driven shaft pin 63 is shown having an end mounted in the driven shaft 52 and projecting radially outward into the slot 58. In the embodiment of FIG. 2A, the driven shaft pin 63 is within the lower terminal area of the projection 60. A spring assembly 64 is illustrated in sectional view that includes a resilient spring 65 set coaxially around the driven shaft 52 and supported on a lower end by a spring support 66 that is coupled to the driven shaft 52. An upper end of the spring 65 is set in an upper spring support 68. The upper spring support 68 mounts around the driven shaft 52 and is axially slideable along the driven shaft 52. Optionally, a thrust bearing 70 is set between the annular upper spring support 68 and lower surface of the collar 54. The spring assembly 64 is constructed so that the spring 65 is put into compression, thereby providing an axial force onto the collar 54 through the upper spring support 68 and thrust bearings 70. The axial force from the spring assembly 64 positions the collar 54 in an uppermost position on the driven shaft 52 and sets the driven shaft pin 63 in a lowermost position within the slot 58.

The upper end of the shaft 52, as shown in dashed outline, terminates between the upper end of the slot 58 and collar upper ends 72. This allows a driveshaft 74 to be inserted into the bore 56 from the upper end of the collar 72. The upper end of the collar 72 is profiled to have a shoulder 76 shown projecting axially upward from the upper end of the collar 72. The shoulder 76 provides a contact point between the collar 54 and a driven pin 78 that is mounted in the driveshaft 74. Thus, as illustrated by the rotational arrows, as the driven shaft 52 is rotated by rotation of the receptacle 36, contact between the driven shaft pin 63 and edge of the slot 58 rotates the collar, that in turn rotates the driveshaft 74 by contact between the shoulder 76 and driveshaft pin 78. An ROV will engage and rotate drive shaft 74.

The spring 65, which in an embodiment is made up of a series of stacked elements, such as Bellville washers, is strategically designed to maintain a sufficient axial force on the collar 54 so the driven shaft pin 63 is maintained in the low point of the projection 60. The design, however, also considers the yield point of the driven shaft 52 and driveshaft 74 and allows the collar 54 and pin 63 to move into a disengaged position. In the example of FIG. 2A, a torque T in the driven shaft 52, applied by rotating drive shaft 74, exerts a force F onto the collar 54 where the driven shaft pin 63 contacts the slot 58. Force F includes a vertical component $F_Y$ oriented substantially along the axis $A_X$ of the torque limiter 50 and a horizontal component $F_X$ that is substantially perpendicular to the vertical component $F_Y$.

Figure 2B:
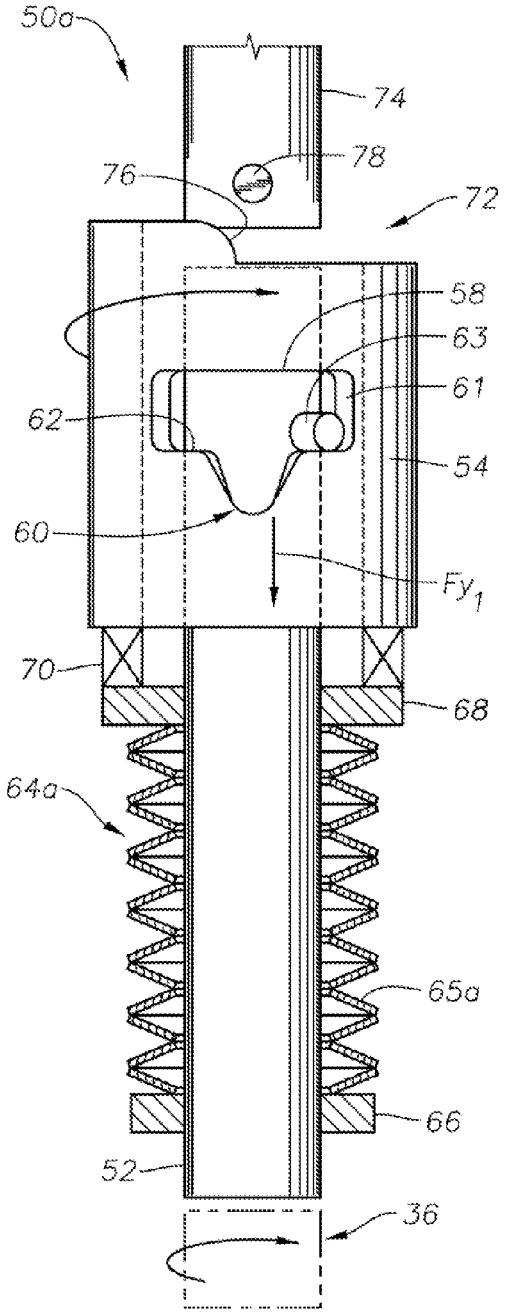
FIG. 2B is a side schematic view of an example embodiment of the torque tripping mechanism of FIG. 2A in a disengaged configuration.

The driven shaft pin 63 will move upward along the lateral side of the projection 60 when the vertical component $F_Y$ exceeds the force for compressing the spring 65. An example of the vertical component $F_Y$ exceeding the spring force is shown in FIG. 2B where the pin 63 is illustrated having moved from the low point in the projection 60 and up to the ledge in the upper portion 61 of the slot 58. As the driven shaft pin 63 moves along the obliquely profiled portion of the slot 58, the collar 54 moves axially downward. Axially moving the collar 54 downward additionally compresses the spring 65 and spring assembly 64A between the anchored spring support 66 and moveable upper spring support 68.

The torque limiter 50 described herein can be assembled so that the spring 65 compresses before a yield point is reached in either the driven shaft 52 or driveshaft 74. By axially moving the collar 54 along the driven shaft 52, the shoulder 76 is taken out of engagement with the driveshaft pin 78, thereby decoupling the driven shaft 52 from the driveshaft 74. As such, the receptacle 36, driven shaft 52, and collar 54 are freely rotatable separate from the driveshaft 74. Moreover, the torque in these members is limited by the value of the vertical component $F_{Y1}$ required to maintain the spring assembly 64A in the compressed configuration of FIG. 2B. Where the vertical component $F_Y$ may have the same magnitude as the vertical component $F_{Y1}$. The torque limiter 50 may be reset to its configuration of FIG. 2A by reversing rotational direction delivered by the ROV through the ROV receptacle 36. Since the stored force in the compressed spring 65 can retract the driven shaft 52 from within the collar 54, thereby drawing the pin 63 back into the low point of the projection 60. One of the many advantages of the present assembly is the ability to avoid downtime as it may be necessary to repair valve stem assembly damaged by over torqueing.

Figure 3:
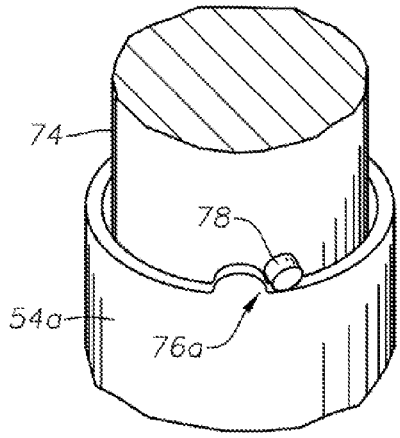
FIG. 3 is a perspective view of an alternative embodiment of a portion of the torque tripping mechanism of FIG. 2A.
Figure 4:
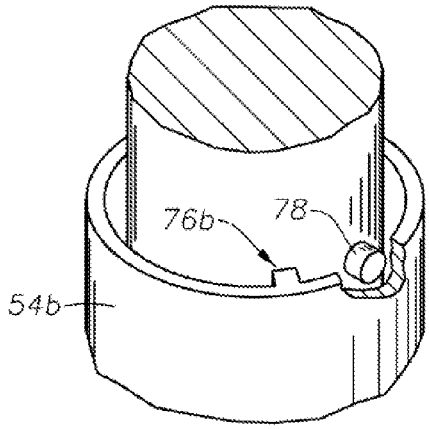
FIG. 4 is a perspective view of an alternative embodiment of a portion of the torque tripping mechanism of FIG. 2A.

Shown in a perspective view in FIGS. 3 and 4 are alternate embodiments of the collar 54 of the torque limiter 50. As illustrated in FIG. 3, the shoulder 76A is a protrusion directed axially from the upper end of the collar 54A along the driveshaft 74 instead of the elongated ridge as shown in FIGS. 2A and 2B. In FIG. 4, the shoulder 76B projects radially inward from an inner surface of the collar 54B into an annular space between the collar 54B and the driveshaft 74.

While the invention has been shown or described in only some of its forms, it should be apparent to those skilled in the art that it is not so limited, but is susceptible to various changes without departing from the scope of the invention.

What is claimed is:

1. A valve for use in a subsea assembly comprising:

a valve member that is stroked between open and closed positions by a rotatable shaft that comprises a drive shaft and a driven shaft having a driven member; and a torque limiting device operably associated with the shaft comprising:

an annular collar and a slot formed through a sidewall of the annular collar having an outer edge that is oblique to an axis of the collar, so that when the torque limiting device is in a locked position the driven member engages the outer edge, and rotation of the driven shaft causes rotation of the drive shaft to stroke the valve member, and so that when the driven member slides along the outer edge in a direction that approaches an end of the collar having a profile, the collar disengages from the drive shaft with the profile disengaged from the shaft that releases the valve member from movement with the shaft when a selected torque on the shaft is reached, and the torque limiting device being resettable from the released position to the locked position.

2. The valve of claim 1, wherein the profile comprises a shoulder formed on an upper end of the collar that contacts a drive member provided on the driveshaft when the torque limiting device is in the locked position.

3. The valve of claim 2, wherein when the driven member slides along the edge of the slot towards the profile, the collar is moved axially so that the profile is urged axially away from the drive, member.

4. The valve of claim 1, wherein a portion of the slot projects in a direction away from the profile with lateral sides oriented oblique to an axis of the collar that intersect to define a wedge shaped drive end of the slot.

5. The valve of claim 4, wherein when the driven member slides along the lateral sides away from the drive end of the slot, the torque limiting device changes from the locked position to the released position.

6. The valve of claim 1, further comprising a spring member mounted on the driven shaft for urging the collar into a position for rotating engagement with both the driveshaft and the driven shaft.

* * * * *

UNITED STATES PATENT AND TRADEMARK OFFICE

CERTIFICATE OF CORRECTION

PATENT NO. : 8,403,054 B2
APPLICATION NO. : 12/870518
DATED : March 26, 2013
INVENTOR(S) : Udipi et al.

It is certified that error appears in the above-identified patent and that said Letters Patent is hereby corrected as shown below:

On the Title Page, in Item (56), under "OTHER PUBLICATIONS", in Column 2, Line 1, delete "orresoonding" and insert -- corresponding --, therefor.

In the Claims:

In Column 6, Line 29, in Claim 3, delete "drive, member." and insert -- drive member. --, therefor.

Signed and Sealed this
Seventeenth Day of September, 2013

Teresa Stanek Rea
*Deputy Director of the United States Patent and Trademark Office*